US009924840B2

(12) United States Patent
Nonaka

(10) Patent No.: US 9,924,840 B2
(45) Date of Patent: Mar. 27, 2018

(54) TOILET SEAT SHEET

(71) Applicant: Akiyoshi Nonaka, Usuki (JP)

(72) Inventor: Akiyoshi Nonaka, Usuki (JP)

( * ) Notice: Subject to any disclaimer, the term of this patent is extended or adjusted under 35 U.S.C. 154(b) by 0 days.

(21) Appl. No.: 15/316,352

(22) PCT Filed: Nov. 21, 2014

(86) PCT No.: PCT/JP2014/080905
§ 371 (c)(1),
(2) Date: Dec. 6, 2016

(87) PCT Pub. No.: WO2016/031092
PCT Pub. Date: Mar. 3, 2016

(65) Prior Publication Data

US 2017/0188761 A1 Jul. 6, 2017

(30) Foreign Application Priority Data

Aug. 27, 2014 (JP) ..... 2014-172313

(51) Int. Cl.
*A47K 13/14* (2006.01)
*A47K 13/16* (2006.01)

(52) U.S. Cl.
CPC ..... *A47K 13/16* (2013.01)

(58) Field of Classification Search
CPC ..... A47K 13/16
See application file for complete search history.

(56) References Cited

U.S. PATENT DOCUMENTS 1,744,300 A * 1/1930 Dewaide ..... A47K 13/16 4/245.9
1,776,333 A * 9/1930 Oates ..... A47K 13/16 4/244.2
4,875,242 A * 10/1989 Albrecht ..... A47K 13/16 4/245.4

(Continued)

FOREIGN PATENT DOCUMENTS

FR 319032 A 2/1902
JP 64-39092 U 3/1989
JP 2000-175842 A 6/2000

OTHER PUBLICATIONS

International Search Report dated Feb. 10, 2015 issued in corresponding PCT/JP2014/080905 application (2 pages).
English Abstract of JP 2000-175842 published Jun. 27, 2000.

*Primary Examiner* — Huyen Le
(74) *Attorney, Agent, or Firm* — Millen, White, Zelano & Branigan, P.C.; William Nixon

(57) ABSTRACT

A toilet seat sheet capable of being automatically disposed from a toilet seat and causing less discomfort to a user is provided. The toilet seat sheet is provided with a sheet main body 1, an opening 2 formed in a center portion of the sheet main body 1, a hanging part 3 configured to hang down from an inner edge portion 21 of the opening 2. The hanging part 3 is provided with a hanging part connecting part 311 which is connected to the sheet main body 1 at an obliquely right front side or an obliquely left front side of the inner edge portion 21 of the opening 2, and is designed to have a length that allows the hanging part 3 to come into contact with an inner front-side surface of a toilet bowl when the sheet main body 1 is placed on the toilet seat.

11 Claims, 8 Drawing Sheets

(56) References Cited

U.S. PATENT DOCUMENTS

| | | | | |
|---|---|---|---|---|
| 6,813,784 | B1 * | 11/2004 | Thompson | A47K 13/16<br>4/245.1 |
| 7,254,845 | B1 | 8/2007 | Morad | |
| 7,328,465 | B1 | 2/2008 | Morad | |

* cited by examiner

TOILET SEAT SHEET

TECHNICAL FIELD

The present invention relates to a toilet seat sheet to be used by placing on a toilet seat of a Western-style toilet.

BACKGROUND TECHNIQUE

When using a Western-style toilet in a public restroom, it is requested that the toilet seat with which a user's skin comes into direct contact be kept clean and hygienic.

However, in a Western-style toilet installed in a public restroom, there rarely exists a toilet provided with special countermeasures for keeping the toilet seat clean and hygienic. In order to prevent one's skin from coming into direct contact with the toilet seat, a user generally places tissue papers or toilet papers cut into desired lengths on the toilet seat.

However, since the size of the cut toilet paper does not meet the standard of the toilet seat, it is difficult to stably arrange the toilet paper on the toilet seat, and therefore there are problems that a user often feels uneasy about shifting of the toilet paper on the toilet seat when using the toilet, and that it is extremely uneconomical because more than necessary amounts of toilet papers are tend to be cut to relive the concern that the user's skin may come into contact with the toilet seat.

Especially, a latest toilet seat is different from a conventional toilet seat that the entire surface of the toilet seat is relatively flat. That is, for the purpose of fitting to a users' body shape (specifically, the shape of a gluteal region when seated) to make the seated feeling better, many toilet seats employ a structure in which the toilet seat surface is slightly and downwardly inclined toward the inner peripheral edge portion from the outer peripheral edge portion. For this reason, when a tissue paper or a toilet paper is placed on the surface of the toilet seat, the placed paper moves from the outer peripheral edge portion toward the inner peripheral edge portion along the inclination of the toilet seat to slip down into the toilet bowl, causing a problem that a stable arrangement of the paper cannot be maintained.

Therefore, as shown in Patent Document 1, a toilet seat sheet is proposed in which an elliptical opening is formed in a center of a rectangular sheet made of a water-soluble paper. Such a toilet seat sheet will not slip down from the toilet seat, and therefore can be stably placed thereon. However, at the time of disposing the toilet seat sheet by flushing it in the toilet bowl after the use of toilet, a user had to remove the toilet seat sheet from the toilet seat to put it into the toilet bowl.

Therefore, as shown in Patent Document 2, a toilet seat sheet is proposed in which an elliptical hanging part is formed in a center of a rectangular sheet having a size capable of covering the entire toilet seat and the hanging part is connected to the sheet main body at the inner rear-side edge portion of the opening. In the toilet seat sheet, when the sheet main body is placed on the toilet seat, the hanging part hangs down toward the inner rear-side surface of the toilet bowl to form an opening for excretion. At this time, when the hanging part comes into contact with the inner rear-side surface of the toilet bowl, the hanging part is pulled in by the flow of the flushing water after the use of toilet, resulting in an automatic disposal of the toilet seat sheet from the toilet seat. However, since the inner rear-side surface of the toilet bowl is deep and steep in slope, the hanging part often did not come into contact with the inner rear-side surface of the toilet bowl. Therefore, in some cases, the hanging part was not pulled in by the flow of the flushing water after the use of toilet and the toilet seat sheet could not be automatically disposed from the toilet seat. Further, in the case of a toilet seat with a bidet function in which the gluteal region is automatically washed after the use of toilet, there also was a risk that the hanging part of the toilet seat sheet covers the nozzle of the toilet seat with a bidet function.

Under the circumstances, as shown in Patent Document 3, a toilet seat sheet is proposed in which a hanging part is formed in a center and the hanging part is connected to the sheet main body at the foremost end of the inner edge portion of the opening. In this case, since the inner front-side surface of the toilet bowl is shallow and the slope is gentle, the hanging part assuredly comes into contact with the inner front-side surface of the toilet bowl. Therefore, the hanging part can be pulled in by the flow of the flushed water after the use of toilet, so that the toilet seat sheet can be automatically disposed from the toilet seat.

PRIOR ART DOCUMENT

Patent Document

Patent Document 1: Japanese Utility Model Registration No. 3062768

Patent Document 2: Japanese Utility Model Application Publication No. H7-33200

Patent Document 3: Japanese Utility Model Registration No. 3081049

SUMMARY OF THE INVENTION

Problems to be Solved by the Invention

However, in such a toilet seat sheet, since the hanging part is arranged at the foremost end of the opening, a user may feel uncomfortable because, for example, the hanging part in which the user's urine has been deposited comes into view of the user and when the user is male, the user's body part may come into contact with the hanging part.

The present invention was made in view of the aforementioned problems, and aims to provide a toilet seat sheet capable of being automatically disposed from a toilet seat and relieving user's discomforts.

Problems to Solved by the Invention

To solve the aforementioned problems, the present invention provides a toilet seat sheet including a sheet main body, an opening formed in a center of the sheet main body, and a hanging part configured to hang down from an inner edge portion of the opening. The hanging part includes a hanging part connecting part connected to the sheet main body on an obliquely right front side or an obliquely left front side of the inner edge portion of the opening. When the sheet main body is placed on a toilet seat, the hanging part hangs down from the hanging part connecting part, and comes into contact with an inner front-side surface of a toilet bowl.

With this, since the hanging part assuredly comes into contact with the inner front-side surface of the toilet bowl, the hanging part is pulled in by the flow of the flushing water after the use of toilet, and the pulled hanging part pulls in the sheet main body 1 via the hanging part connecting part, and therefore the toilet seat sheet can be automatically disposed from the toilet seat. Further, since the hanging part is arranged on an obliquely right front side or an obliquely left front side of the opening, discomfort for a user, such as, e.g., the hanging part in which the user's urine has been deposited comes into view of the user, and the hanging part comes into contact with the user's body part when the user is male, can be relieved.

Further, the hanging part is preferably formed to have the same size and the same shape as those of the opening when cut off from the sheet main body. With this, the hanging part and the sheet main body can be integrally formed, facilitating the production of the toilet seat sheet, which in turn can reduce the production cost.

Further, the hanging part connecting part is preferably positioned rearward of a foremost end of the inner edge portion of the opening within a range of 1 cm to 15 cm from the foremost end. With this, the hanging part can more assuredly come into contact with the inner front-side surface of the toilet bowl.

Further, the hanging part connecting part is preferably formed to have a length of 1 cm to 10 cm. With this, by making the length of the hanging part connecting part to be 1 cm or longer, the hanging part connecting part can be prevented from being torn off when pulled in by the flow of the flushing water. Further, by making the length of the hanging part connecting part to be 5 cm or shorter, the hanging part connecting part becomes easy to bend, and the hanging part can more assuredly come into contact with the inner front-side surface of the toilet bowl.

Further, it is preferable that the hanging part connecting part include perforations formed along a lengthwise direction of the hanging part connection part. With this, the hanging part connecting part becomes easy to bend, and the hanging part can more assuredly come into contact with the inner front-side surface of the toilet bowl.

Further, it is preferable that the hanging part include a cutting-off connecting part connected to the sheet main body on an obliquely right rear side and/or an obliquely left rear side of the inner edge portion of the opening, and that the hanging part be configured to hang down from the hanging part connecting part when the cutting-off connecting part is cut off from the sheet main body. With this, since the cutting-off connecting part can be cut off from the sheet main body by the pressure from the gluteal region when a use sits on the toilet seat, it is possible to omit the process of cutting off the cutting-off connecting part by hand.

Further, the cutting-off connecting part is preferably positioned within a range of 130 degrees to 140 degrees from a foremost end of the hanging part centering on a center of gravity of the hanging part. With this, since the cutting-off connecting part is positioned in the direction in which the pressure from the gluteal region becomes larger, the cutting-off connecting part can be assuredly cut off from the sheet main body.

Further, it is preferable that the hanging part include a pulling part at a front end part of the hanging part, and the cutting-off connecting part is cut off from the sheet main body when the pulling part is pulled forward. With this, by pulling the pulling part, the cutting-off connecting part can be assuredly cut off from the sheet main body.

Further, it is preferable that the pulling part include an insertion hole allowing a finger to be inserted and the cutting-off connecting part be cut off from the sheet main body when the pulling part is pulled forward with a finger inserted in the insertion hole. With this, by inserting a finger into the pulling part and pulling forward, the cutting-off connecting part can be more assuredly cut off from the sheet main body.

Further, it is preferable that the hanging part be formed so that a front end part thereof has an acute angle. With this, since the front side of the hanging part becomes lighter and the center of gravity of the hanging part shifts rearward, it becomes easier for the hanging part to hang down from the hanging part connecting part.

Further, it is preferable that the hanging part be formed into a heart shape in a plan view. With this, the user can easily grasp the front and rear of the toilet seat sheet from the heart shape and the design effect of the heart shape can be exerted.

Effects of the Invention

According to the present invention, since the hanging part assuredly comes into contact with the inner front-side surface of the toilet bowl, the hanging part is pulled in by the flow of the flushing water after the use of toilet, and the pulled hanging part pulls in the sheet main body via the hanging part connecting part, and therefore the toilet seat sheet can be automatically disposed from the toilet seat. Further, since the hanging part is arranged on an obliquely right front side or an obliquely left front side of the opening, discomfort for a user, such as, e.g., the hanging part in which the user's urine has been deposited comes into view of the user, and the hanging part comes into contact with the user's body when the user is male, can be relieved. Therefore, it becomes possible for the user to use the toilet seat T comfortably and hygienically.

EMBODIMENTS FOR CARRYING OUT THE INVENTION

Embodiment 1

Figure 1:
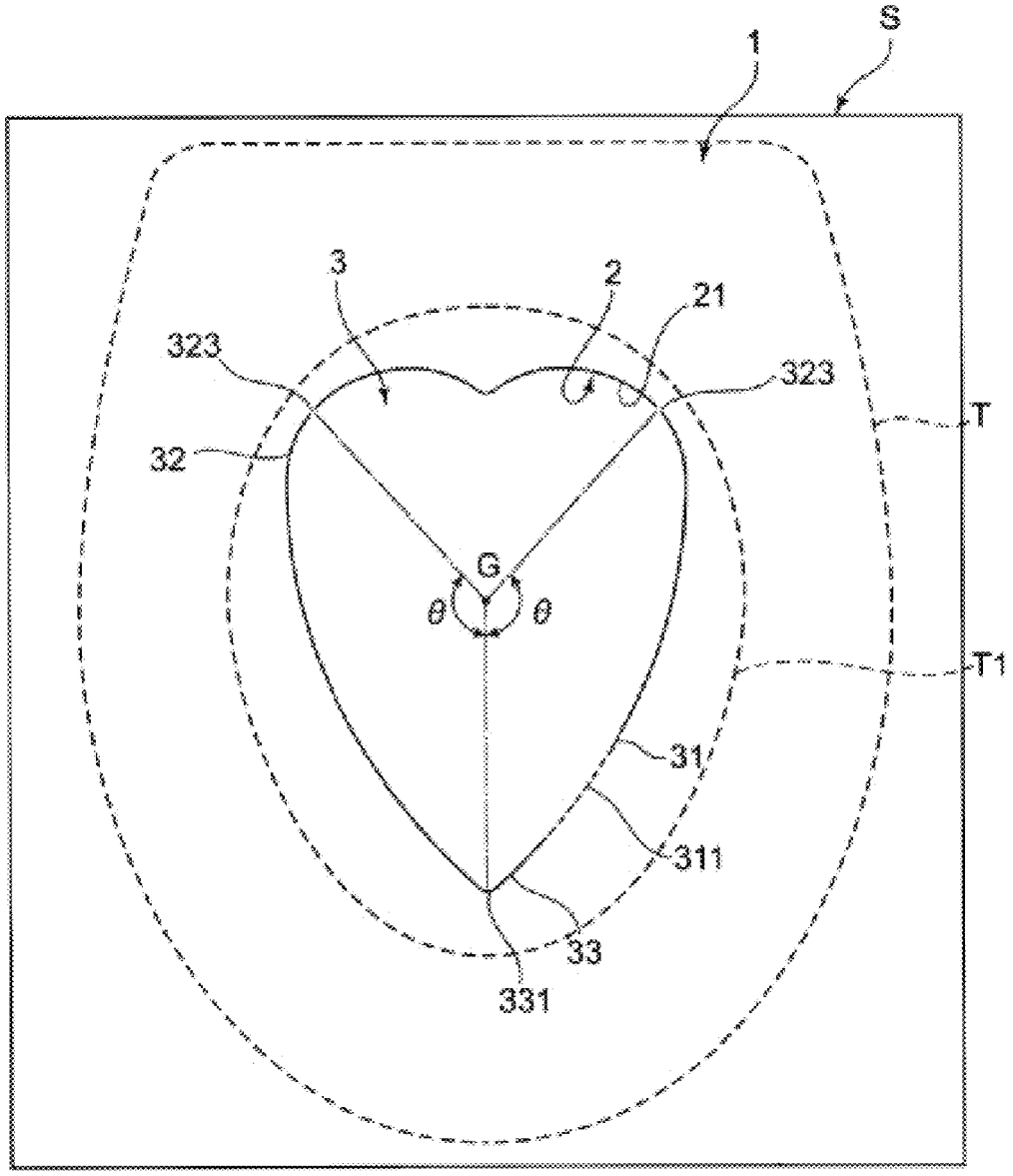
FIG. 1 is a plan view showing a toilet seat sheet according to a first embodiment.

Next, a first embodiment of a toilet seat sheet S according to the present invention will be described with reference to FIG. 1 to FIG. 7. In the present invention, in a state in which a user stands in front of a toilet seat T, the front side of the toilet seat T (bottom side of FIG. 1) is defined as a "front side", the far side of the toilet seat T (upper side of FIG. 1) is defined as a "rear side", the right side of the toilet seat T (right side of FIG. 1) is defined as a "right side", and the left side of the toilet seat T (left side of FIG. 1) is defined as a "left side". The toilet seat sheet S is a toilet seat sheet to be used when using a Western-style toilet and placed on the toilet seat to prevent a user's skin from coming into direct contact with the toilet seat. The toilet seat sheet S is made of a thin rectangular non-woven fabric or paper, and as shown in FIG. 1, provided with a sheet main body 1, an opening 2 formed in the center of the sheet main body 1, and a hanging part 3 configured to hang down from the inner edge portion 21 of the opening 2.

The sheet main body 1 is a portion to be placed on the toilet seat T, and is formed to have a size covering the entire toilet seat T. Specifically, it is formed so that the longitudinal length is 435 mm and the transverse width is 400 m.

The opening 2 is an excretion hole for allowing stool to pass through to dispose the stool, and is formed so that the sheet main body covers the peripheral edge part of the opening T1 of the toilet seat T. Specifically, it is formed so that the longitudinal length passing the center of gravity G is 203 mm, the transverse length passing the center of gravity is 165 mm, and the maximum transverse length is 205 mm.

The hanging part 3 is formed to have the same size and the same shape as those of the opening 2 when cut out from the sheet main body 1. Therefore, the hanging part 3 and the sheet main body 1 can be integrally formed, facilitating the production of the toilet seat sheet S, which in turn can reduce the production cost. In the following description, the front side peripheral edge part of the hanging part positioned forward of the center of gravity G of the hanging part 3 is referred to as a front side edge part 31, and the rear side peripheral edge part of the hanging part 3 positioned rearward of the center of gravity G of hanging part 3 is referred to as a rear side edge part 32.

The hanging part 3 is, as shown in FIG. 1, provided with a hanging part connecting part 311 at the front side edge part 31 on the obliquely right front side. The hanging part connecting part 311 is connected to the inner edge portion 21 of the opening 2 on the obliquely right front side. Further, the hanging part 3 is formed to have a length allowing the hanging part to come into contact with the inner front-side surface I of the toilet bowl when the sheet main body 1 is placed on the toilet seat T. Therefore, when the sheet main body 1 is placed on the toilet seat, the hanging part 3 hangs down from the hanging part connecting part 311 as the basal end and comes into contact with the inner front-side surface I of the toilet bowl.

Figure 2:
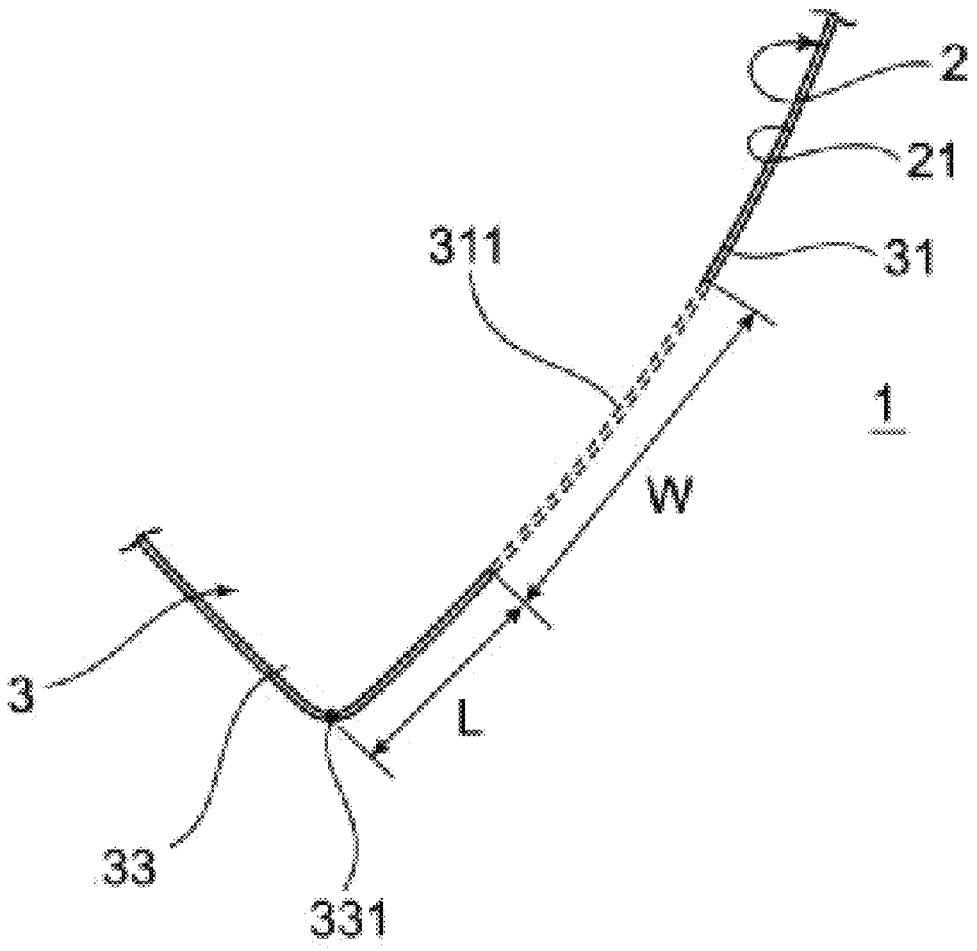
FIG. 2 is an enlarged plan view showing a hanging part connecting part of the toilet seat sheet shown in FIG. 1.

Further, in this embodiment, the front end part of the hanging part connecting part 311 is, as shown in FIG. 2, positioned rearward of the foremost end 331 of the inner edge portion 21 of the opening 2 within a range of 1 cm to 15 cm (L) from the foremost end. Therefore, the hanging part can more assuredly come into contact with the inner front-side surface of the toilet bowl.

Further, the hanging part connecting part 311 is, as shown in FIG. 2, formed to have a length of 1 cm to 10 cm (W). By making the length of the hanging part connecting part 311 to be 1 cm or longer, the hanging part connecting part 311 can be prevented from being torn off when pulled in by the flow of the flushing water. Further, by making the length of the hanging part connecting part 311 to be 5 cm or shorter, the hanging part connecting part 311 can be readily bent, and the hanging part 3 can more assuredly come into contact with the inner front-side surface I of the toilet bowl.

Further, the hanging part connecting part 311 includes perforations each having a size of around 1 mm formed along the lengthwise direction at intervals of around 3 mm. With this, the hanging part connecting part 311 readily bends, and the hanging part 3 can more assuredly come into contact with the inner front-side surface I of the toilet bowl.

Figure 3:
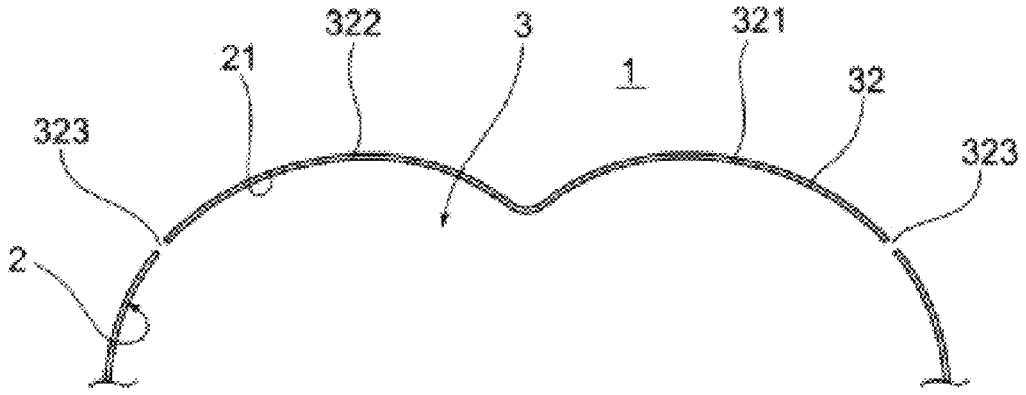
FIG. 3 is an enlarged plan view showing a cutting-off connecting part of the toilet seat sheet shown in FIG. 1.

Further, the hanging part 3 is, as shown in FIG. 3, formed such that a mountain-shaped portion 321 in which the rear side edge part 32 protrudes right obliquely rearward and a mountain-shaped portion 322 in which the rear side edge part 32 protrudes obliquely left rearward are arranged side by side. The hanging part 3 is provided with cutting-off connecting parts 323 each having a length of around 1 mm to 2 mm at the rear side edge parts 32 on the obliquely right rear side and the obliquely left rear side. Also, the cutting-off connecting part 323 on the obliquely right rear side is positioned at the inner edge portion 21 on the obliquely right rear side of the opening 2 and the cutting-off connecting part 323 on the obliquely left rear side is positioned at the inner edge portion 21 on the obliquely left rear side of the opening 2. When the cutting-off connecting parts 323 on both sides are cut off from the sheet main body 1, the hanging part 3 hangs down from the hanging part connecting part 311 as a basal end. Therefore, since the cutting-off connecting parts 323 are cut off from the sheet main body 1 by the pressure from the gluteal region when a user sits on the toilet seat T, it is possible to omit the process of cutting-off the cutting-off connecting part 323 by hand.

In particular, in this embodiment, in the hanging part 3, as shown in FIG. 1, the cutting-off connecting parts 323 are each positioned at an angle θ within a range of 130 degrees to 140 degrees from the front end part 33 of the hanging part 3 centering on the gravity G of the hanging part 3. With this, since the cutting-off connecting parts 323 are each positioned in a direction in which the pressure from the gluteal region becomes larger, the cutting-off connecting parts 323 can be more assuredly cut off.

Further, the hanging part 3 is formed so that the front end part 33 has an acute angle. With this, since the front side of the hanging part 3 becomes lighter and the center of gravity of the hanging part 3 is shifted toward the rear side, it becomes easier for the hanging part 3 to hang down from the hanging part connecting part 311. In particular, in this embodiment, the hanging part 3 is provided with the front side edge part 31 and the rear side edge part 32, so that the hanging part 3 is formed into a heart shape in a plan view. Therefore, a user can easily grasp the front and the rear side of the toilet seat sheet S from the heart shape in a plan view, and that the heart shape can exert design effects.

Hereinafter, a method of using the toilet seat sheet S will be described.

First, a producer folds the toilet seat sheet S and packs one or a plurality of the folded toilet seat sheets in a packaging bag.

Figure 4:
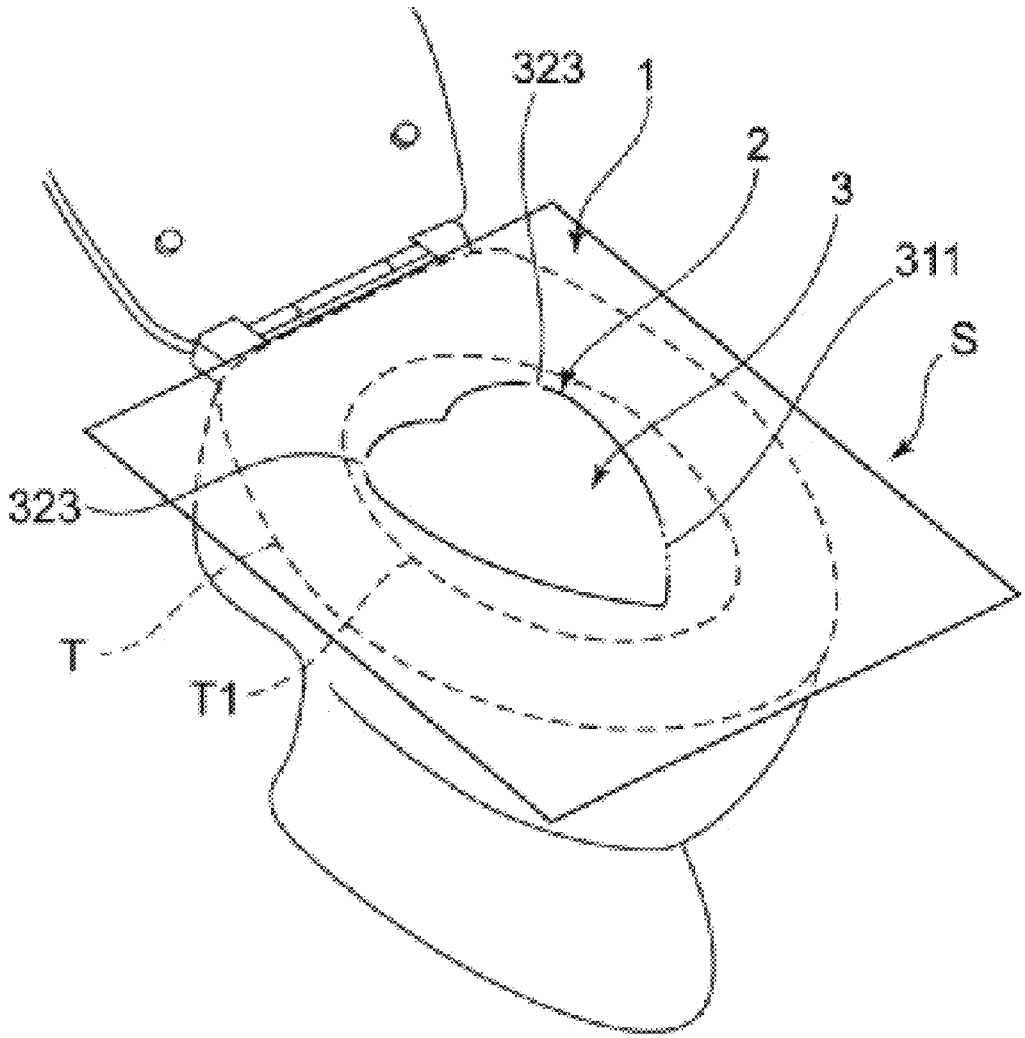
FIG. 4 is a perspective view showing a state in which the toilet seat sheet shown in FIG. 1 is in use.

Next, as shown in FIG. 4, in a Western-style toilet, a user who purchased the packaged toilet seat sheets S takes out a toilet seat sheet S from the packaging bag and spreads it out and places it on the toilet seat T so as to cover the seat. At that time, the front side of the toilet seat sheet S (the side of the heart shape in a plan view formed as an acute angle) is arranged on the front side of the toilet seat T, the rear side of the toilet seat sheet S (the side in which two mountain-shaped portions 322 of the heart shape in a plan view are formed) is arranged on the far side of the toilet seat T, and the user adjusts the position of the toilet seat sheet S in a plane direction so that the peripheral edge portion 21 of the opening 2 of the toilet seat sheet S is arranged inside the opening T1 of the toilet seat T. In particular, in this embodiment, since the toilet seat sheet S is formed into a heart shape in a plan view, the front and rear of the toilet seat sheet S can be easily recognized, making it convenient. Further, in this state, the cutting-off connecting parts 323 of the hanging part 3 are in a state of being connected to the sheet main body 1, and the hanging part 3 has not yet hung downward.

Then, the user takes down one's clothing and sits on the toilet seat T on which the toilet seat sheet S is placed. At that time, since the cutting-off connecting parts 323 are positioned in the direction in which the pressure from the gluteal region becomes larger, the cutting-off connecting part 323 of the rear side edge part 32 can be assuredly cut off from the sheet main body 1 due to the pressure from the gluteal region. Therefore, the user can omit the process of cutting off the cutting-off connecting parts 323 by hand.

Figure 5:
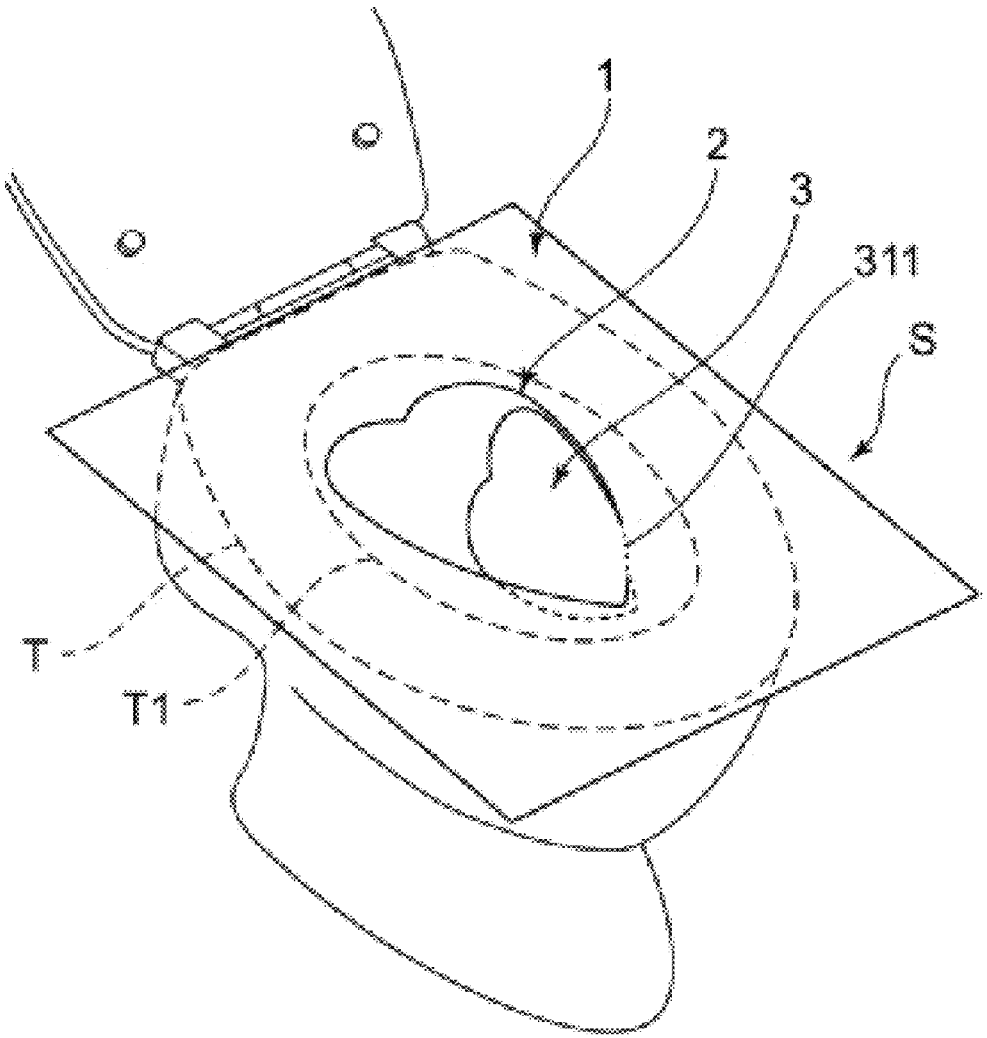
FIG. 5 is a perspective view showing a state in which the toilet seat sheet shown in FIG. 1 is in use.
Figure 6:
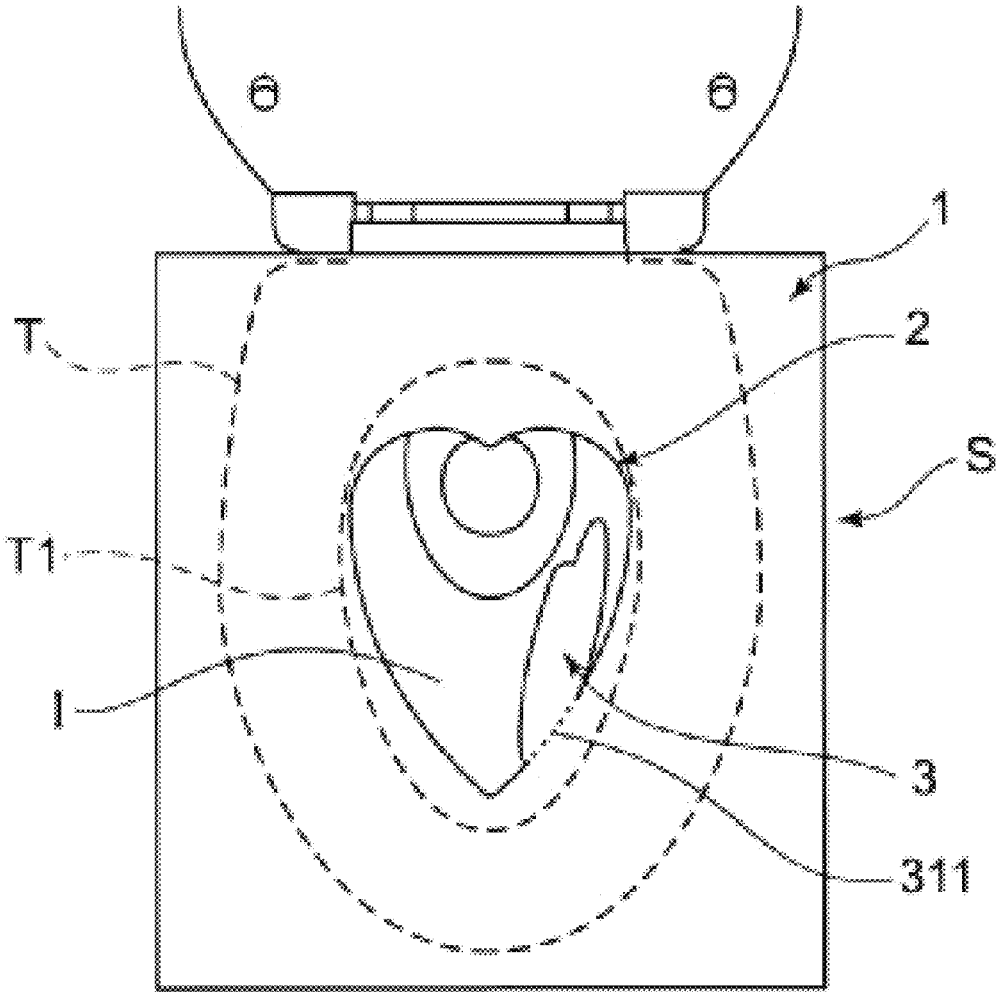
FIG. 6 is a plan view showing a state in which the toilet seat sheet shown in FIG. 1 is in use.
Figure 7:
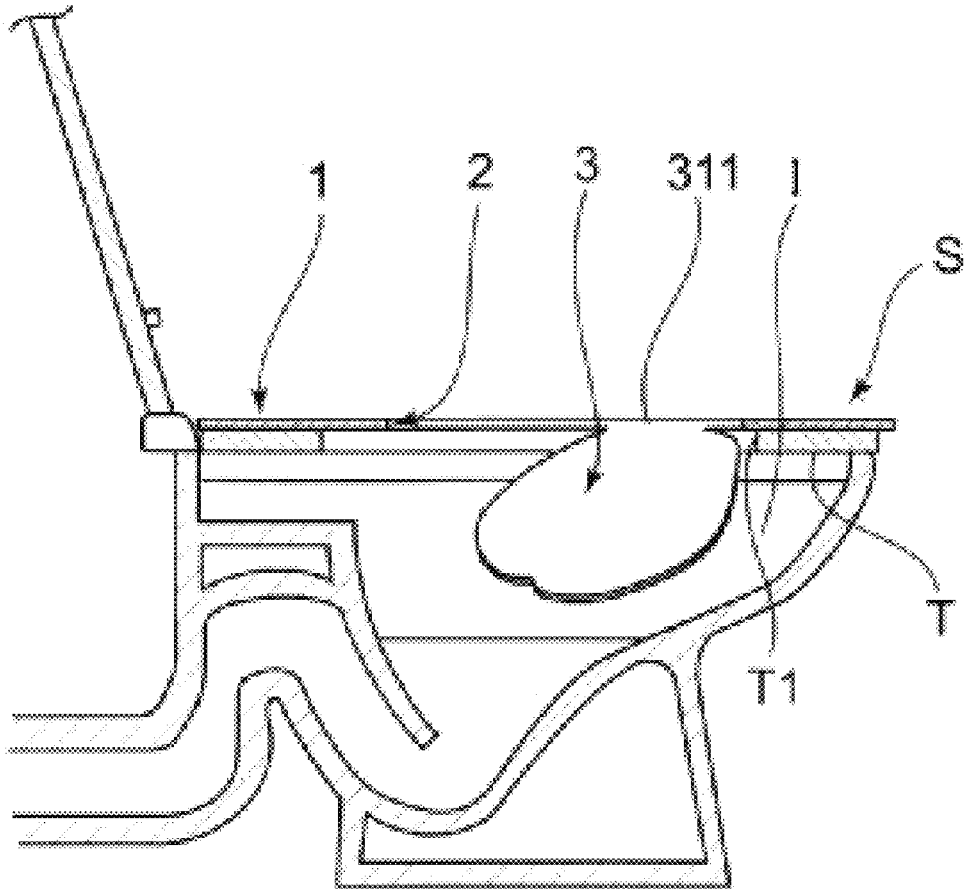
FIG. 7 is a vertical cross-sectional view showing a state in which the toilet seat sheet shown in FIG. 1 is in use.

Then, as shown in FIG. 5 to FIG. 7, since the cutting-off connecting parts 323 are cut off from the sheet main body 1, the hanging part 3 hangs down from the hanging part connecting part 311 as the basal end and comes into contact with the inner front-side surface I of the toilet bowl. At that time, since the hanging part 3 is arranged on the obliquely right front of the opening 2, as shown in FIG. 6, discomfort for users, such as, e.g., the hanging part 3 in which the user's urine has been deposited comes into view of the user, and the hanging part 3 comes into contact with the user's body part when the user is male, can be relieved.

Next, the user defecates through the opening 2 formed when the hanging part 3 hangs down. Then, the user wipes one's bottom and drops the used toilet paper into the toilet bowl.

Finally, the user stands up to separate one's gluteal region from the toilet seat sheet S and flushes the flushing water. With this, the hanging part 3 in contact with the inner surface I of the toilet bowl is pulled in by the flushing water, and the pulled hanging part 3 pulls the sheet main body 1 via the hanging part connecting part 311, and therefore the toilet seat sheet S can be automatically disposed from the toilet seat B. Therefore, it becomes possible for a user to comfortably and hygienically use the toilet seat T.

In addition, in FIG. 4 to FIG. 7, the sheet main body 1 is described in a flat plate shape, but that is for the convenience of explanation, and actually, the peripheral edge part of the sheet main body 1 is bent downward along the edge part of the outside of the toilet seat T.

Embodiment 2

Figure 8:
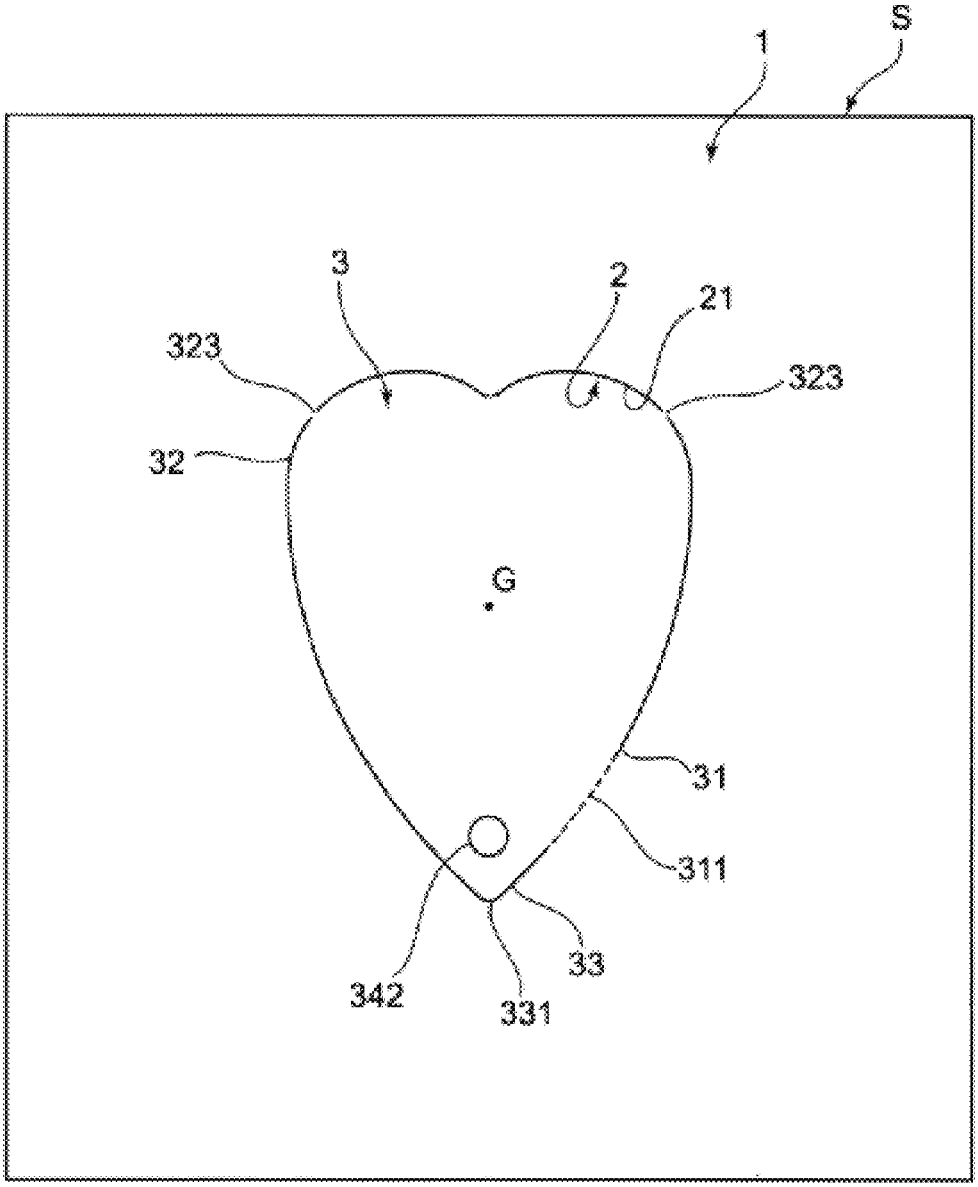
FIG. 8 is a plan view showing a toilet seat sheet according to a second embodiment.

Next, a second embodiment of the toilet seat sheet S according to the present invention will be explained with reference to FIG. 8. Hereinafter, only the structures different from the aforementioned embodiment will be explained, and the explanations of the same structures will be omitted and the same symbols will be used.

The toilet seat sheet S according to this embodiment is provided with a pulling part 34 at the front end part 33 of the hanging part 3. The pulling part 34 is cut out in a circular shape so as to form an insertion hole 341 in which a finger can be inserted. Therefore, by inserting a finger in the insertion hole 341 and pulling forward, the cutting-off connecting parts 323 can be more assuredly cut off from the sheet main body 1.

In addition, in the aforementioned embodiment, the hanging part connecting part 311 is provided at the front side edge part 31 on the obliquely right front side, but it may be provided at the front side edge part 31 on the obliquely left front side.

Further, perforations are formed along the lengthwise direction of the hanging part connecting part 311, but perforations do not always need to be formed.

Furthermore, the hanging part 3 is provided with cutting-off connecting parts 323 at the rear side edge part 32 on the obliquely right rear side and the obliquely left rear side, but the cutting-off connecting parts 323 may be provided on the rear side edge part 32 on either the obliquely right rear side or the obliquely left rear side, and the cutting-off connecting parts 323 do not need to be provided.

The embodiments of the present invention were explained above with reference to the drawings, but the present invention is not limited to the illustrated embodiments. For the illustrated embodiments, within the same scope of the present invention or within the equivalent scope, various changes and modifications may be added.

DESCRIPTION OF THE REFERENCE NUMERALS

1 sheet main body
2 opening
21 inner edge portion
3 hanging part
31 front side edge part
311 hanging part connecting part
32 rear side edge part
323 cutting-off connecting part
33 front end part
331 foremost end
34 pulling part
342 insertion hole
S toilet seat
I inner surface of the toilet bowl

The invention claimed is:

1. A toilet seat sheet comprising:
a sheet main body;
an opening formed in a center of the sheet main body; and
a hanging part configured to hang down from an inner edge portion of the opening,
wherein the hanging part includes a hanging part connecting part connected to the sheet main body on an obliquely right front side or an obliquely left front side of the inner edge portion of the opening, and
wherein when the sheet main body is placed on a toilet seat, the hanging part hangs down from the hanging part connecting part and comes into contact with an inner front-side surface of a toilet bowl.

2. The toilet seat sheet as recited in claim 1, wherein the hanging part is formed to have the same size and the same shape as those of the opening when cut off from the sheet main body.

3. The toilet seat sheet as recited in claim 1, wherein the hanging part connecting part is positioned rearward of a foremost end of the inner edge portion of the opening within a range of 1 cm to 15 cm from the foremost end.

4. The toilet seat sheet as recited in claim 1, wherein the hanging part connecting part is formed to have a length of 1 cm to 10 cm.

5. The toilet seat sheet as recited in claim 1, wherein the hanging part connecting part includes perforations formed along a lengthwise direction of the hanging part connection part.

6. The toilet seat sheet as recited in claim 1,
wherein the hanging part includes a cutting-off connecting part connected to the sheet main body on an obliquely right rear side and/or an obliquely left rear side of the inner edge portion of the opening, and
wherein the hanging part is configured to hang down from the hanging part connecting part when the cutting-off connecting part is cut off from the sheet main body.

7. The toilet seat sheet as recited in claim 6, wherein the cutting-off connecting part is positioned within a range of 130 degrees to 140 degrees from a foremost end of the hanging part centering on a center of gravity of the hanging part.

8. The toilet seat sheet as recited in claim wherein the hanging part includes a pulling part at a front end part of the hanging part, and the cutting-off connecting part is cut off from the sheet main body when the pulling part is pulled forward.

9. The toilet seat sheet as recited in claim 8, wherein the pulling part includes an insertion hole allowing a finger to be inserted, and the cutting-off connecting part is cut off from the sheet main body when the pulling part is pulled forward with a finger inserted in the insertion hole.

10. The toilet seat sheet as recited in claim 1, wherein the hanging part is formed so that a front end part thereof has an acute angle.

11. The toilet seat sheet as recited in claim 10, wherein the hanging part is formed into a heart shape in a plan view.

* * * * *